United States Patent [19]

Zidek

[11] 4,114,553

[45] Sep. 19, 1978

[54] MOORING DEVICE AND CLEAT

[76] Inventor: Charles E. Zidek, 9851 Robin Rd., Niles, Ill. 60648

[21] Appl. No.: 816,349

[22] Filed: Jul. 18, 1977

[51] Int. Cl.[2] ..... B63B 21/04

[52] U.S. Cl. ..... 114/230; 24/128; 114/218

[58] Field of Search ..... 114/218, 230; 24/115 R, 24/115 A, 115 C, 115 D, 128 R, 129 R, 129 C, 129 D, 130, 131 R

[56] References Cited

U.S. PATENT DOCUMENTS

| | | | |
|---|---|---|---|
| 1,587,858 | 1/1926 | Reitz | 24/129 R |
| 3,094,755 | 6/1963 | Casanave | 114/230 |
| 3,473,505 | 10/1969 | Brown | 114/230 |
| 3,636,594 | 1/1972 | Faivre | 24/128 |

FOREIGN PATENT DOCUMENTS

| | | | |
|---|---|---|---|
| 21,740 of | 1904 | United Kingdom | 114/218 |

*Primary Examiner*—Trygve M. Blix

*Assistant Examiner*—D. W. Keen

*Attorney, Agent, or Firm*—John J. Kowalik

[57] ABSTRACT

A device for mooring marine units when attached to a wharf or which serves as a cleat when mounted on the deck of a boat. The device comprises a hollow yieldable plastic or preferably metallic tubular anchor element with open ends at opposite ends of a bore defined by the walls of the element, which when secured in upright position serves as a chimney for circulating air therethrough to maintain the rope anchor element relatively cool.

Certain walls of the tube are provided with keyhole shape slots which are open at the ends of the tube for admitting a rope therethrough which is slid endwise of the slot to the enlarged circular terminal inner end. To prevent its withdrawal, the rope has a knot larger than the slot. In the plastic tube the edges of the slots can be spread so that the rope will pass tightly therethrough and the resilient nature of the plastic acts to yieldingly resist tugging as the boat rides up and down.

8 Claims, 9 Drawing Figures

MOORING DEVICE AND CLEAT

DISCUSSION OF THE PRIOR ART

In a preliminary search, the following U.S. Patent art was found: U.S. Pat. Nos. 695,699; 3,094,755; 3,110,046; 3,101,695; 541,729; 281,704; and 3,473,505.

The most pertinent of these patents appears to be U.S. Pat. No. 3,473,505. However, all that this reference shows is merely a series of curved hooks, providing slots therebetween so that a weighted line can be thrown to hooks and caught in the slots.

SUMMARY

This invention pertains to marine mooring and tethering devices and more specifically to a novel unit through which a line may be easily laced and locked into slots extending inwardly from opposite ends of the unit.

The invention contemplates the provision of a novel tubular anchoring unit with key slots therein, the tube being sized to pass the mooring line therethrough so that the line may be passed through a slot in one end of the tube extended through the bore of the tube, and then passed through the slot in the other end of the tube and then tightly snubbed.

The invention comprehends the provision of a tubular member having openings in one wall for securing screws to associated support structure, the tube being so arranged that it can be secured to the wharf piling in an upright position, whereat the line-slots are vertically oriented so that a boat mooring line can be easily slid into the slot through the open upper end, and if additional securement is desired, the line can be extruded through the tube and reinserted into a lower end slot, and if necessary, the line can then be extended along the outside of the tube and passed through any of the upper slots, thus affecting a good securement.

A further object in one of the embodiments is to provide a novel flexible anchoring element made of suitable plastic in which the rope-admitting slots can be spread to admit a rope of slightly larger diameter than the normal spacing of the edges of the slot.

Another object is to provide a device which effectively channels air currents therethrough for cooling the device so that upon exposure to the intense sun, it will not become so heated as to burn the user's hands.

The device in one embodiment comprises a boxsection metal tube which has inner and outer walls and interconnecting side walls forming a rectangular hollow structure, the inner wall having holes for securing screws and preferably different-width keyhole-shaped line slots in the side walls and the outer wall having air holes therein through which the securing screws are passed into the back-wall holes.

These and other objects and advantages inherent in and encompassed by the invention will become more apparent from the specification and drawings, wherein.

DESCRIPTION OF EMBODIMENT OF FIGS. 1-6

Figure 1:
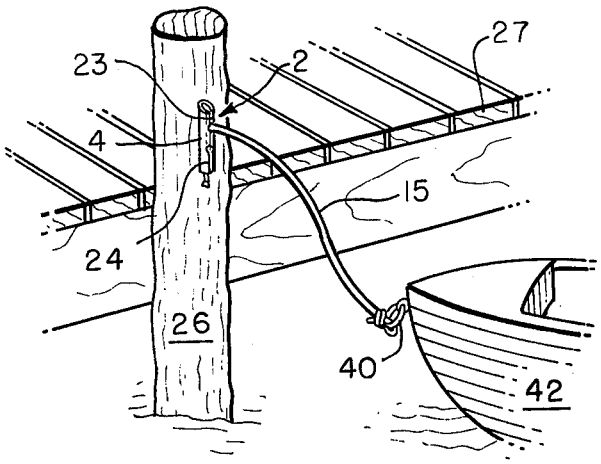
FIG. 1 is a perspective view of the device shown in mounted position on a piling and connected to a line of a boat.

The novel mooring device 2 comprises a tubular member 4 preferably of cylindrical shape which is positioned upright having upper and lower openings 6 and 8 and diagonally sheared upper and lower edges 10 and 12 so that they slope toward the forward side 14 of the tube. This feature enlarges and shapes the holes 6 and 8 as ovals to facilitate admittance of the boat securing line or rope 15 to the element 4.

Figure 2:
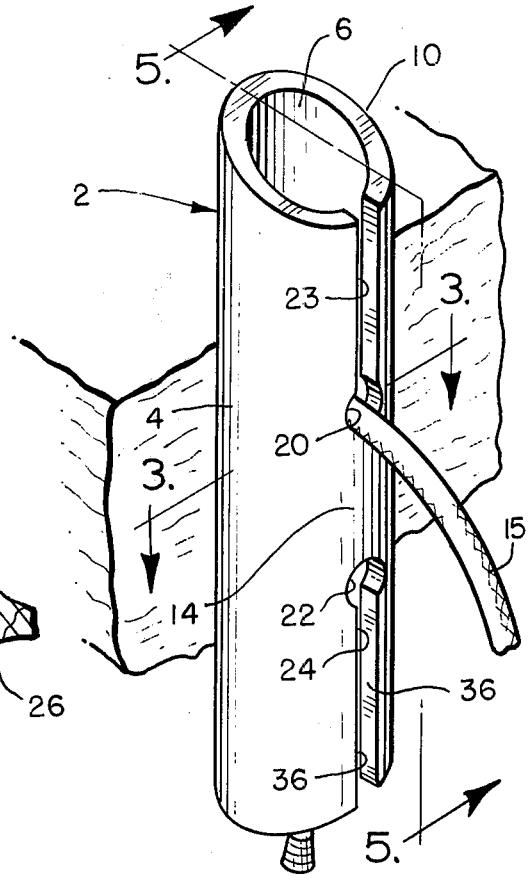
FIG. 2 is an enlarged perspective view of the device shown mounted.
Figure 3:
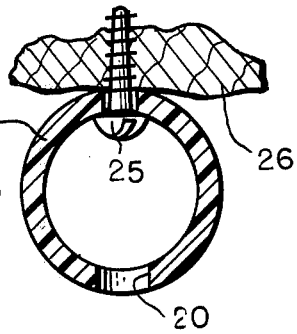
FIG. 3 is a cross-sectional view taken substantially on line 3—3 of FIG. 2.
Figure 4:
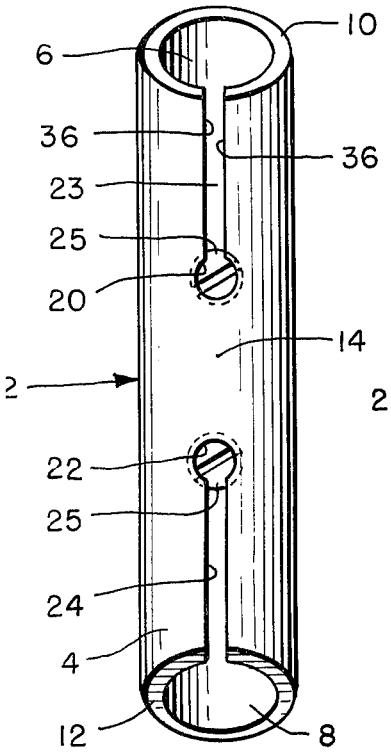
FIG. 4 is a front side elevational view of the device.

The element 4 has a series of holes 16, 16 in its back wall portion 18 which are diametrically aligned with the circular inner end portions 20, 22 of the upper and lower keyhole-shaped slots 23, 24 to permit insertion of a tool such as a screw driver therethrough to apply and remove the screws 25, 25 which extend into a piling post 26 or other structure as in FIG. 2 of a wharf 27 or the like.

The upper slot 22 extends through the upper edge 10 and the lower slot 24 extends through the lower edge 22 and admits the rope or cord 15 thereinto.

Figure 5:
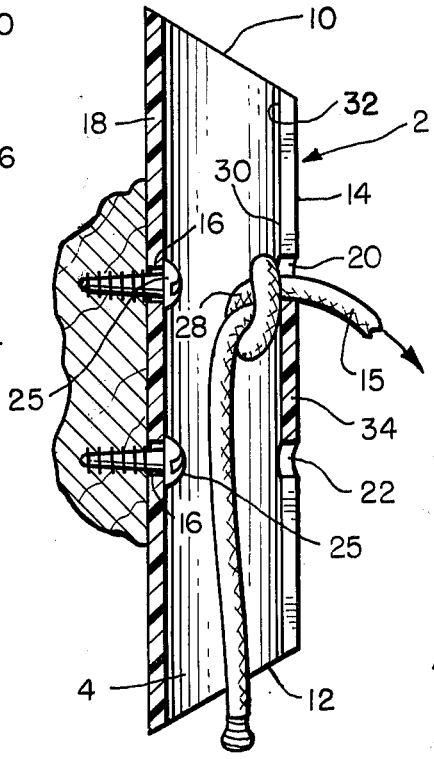
FIG. 5 is a vertical section taken on line 5—5 of FIG. 2.
Figure 6:
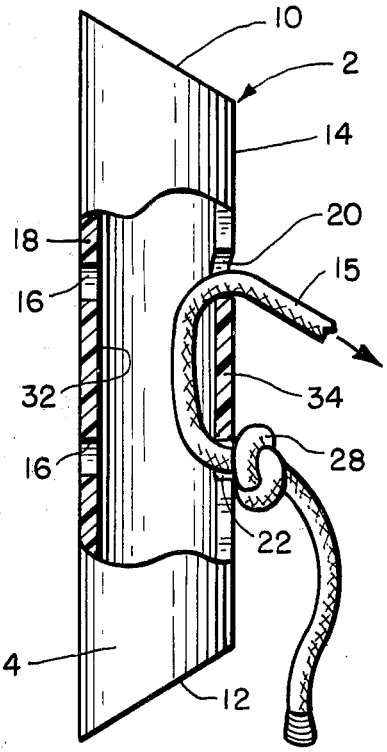
FIG. 6 is a side elevational view partly broken away showing the rope laced therethrough.
Figure 7:
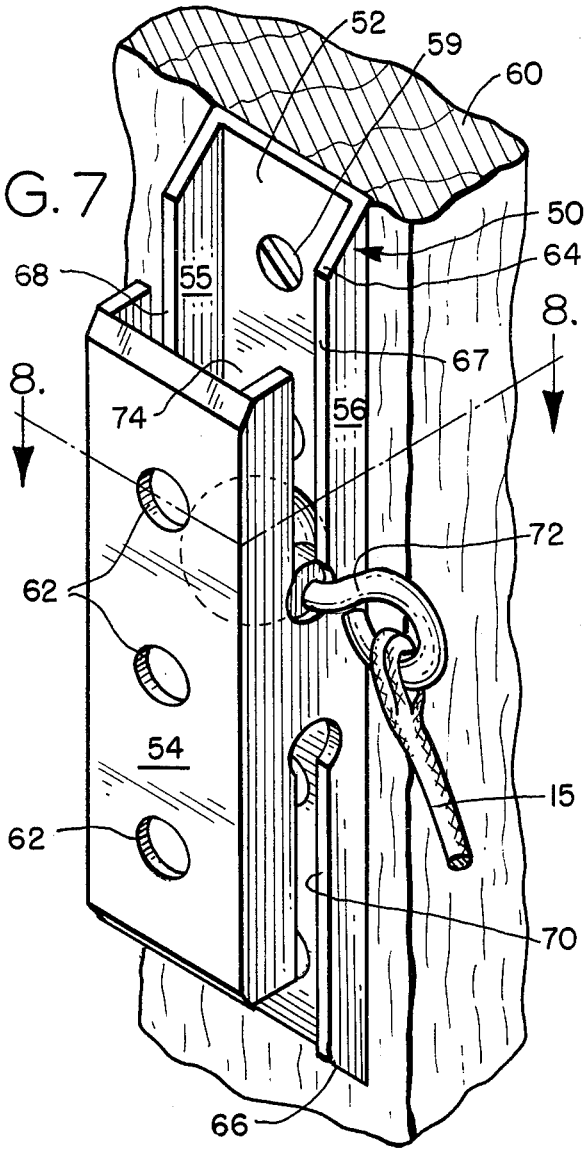
FIG. 7 is a perspective view of another embodiment of the invention.
Figure 9:
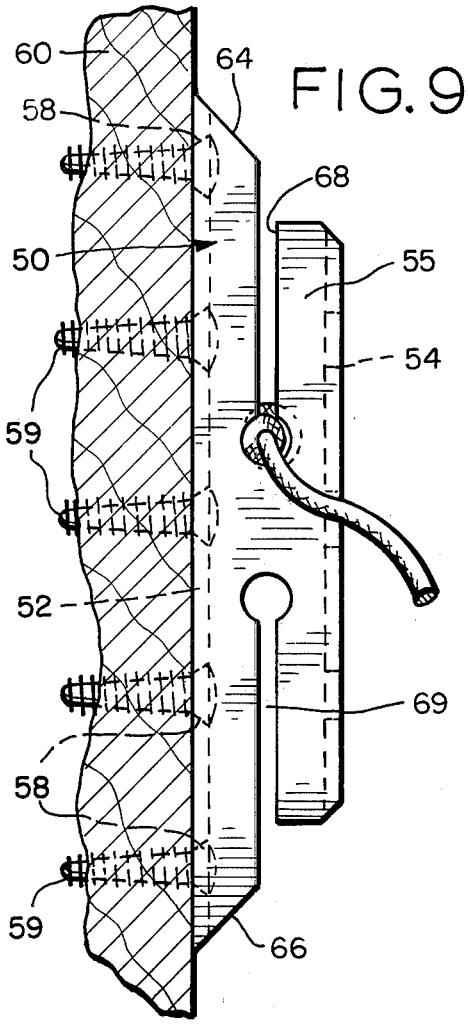
FIG. 9 is a side elevational view showing the support in vertical section.
Figure 8:
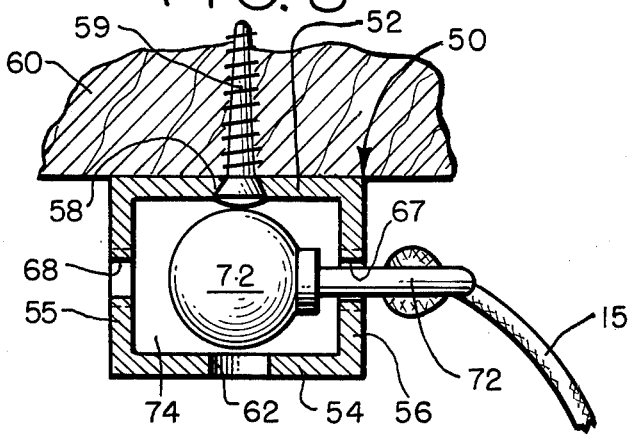
FIG. 8 is a cross-section taken on line 8—8 of FIG. 7.

The rope 15 has an enlargement such as a knot 28 adjacent to its free end which is of larger diameter than the circular head 20 or 22 and thus in the position shown in FIGS. 5 or 6 cannot be removed except by pulling the cord up or down as necessity requires.

As best seen in FIG. 5 the cord is passed through the upper slot only and the knot bears against the internal side 30 of the tube. If more securement is desired, the cord may be pulled through the bore 32 of the tube and then upwardly through the lower slot into the associated enlarged head as shown in FIG. 6. If desired the cord can be pulled up further, and passed the second time through the upper slot so that the cord is wrapped about the intermediate portion 34 of the external wall of the tube. The knot lays against the interior of the tube.

In this embodiment it is preferred that the tube be made of plastic, such as nylon or polypropylene or the like so that the slot widths can be made smaller than the diameter of the cord or cable and the flexible nature of the material will permit the side edges 36, 36 of each slot to be spread apart to snugly admit the cable therethrough into the enlargement at the base of the slot.

As best seen in FIG. 1 the cable is suitably anchored at 40 to the boat 42. The arrangement of the device permits any water from the rope to drain down readily and the base is of a size to permit air currents to flow upwardly to keep the tube relatively cool.

EMBODIMENT OF FIGS. 7-9

This embodiment in essence is the same as the previous one, but is preferably made of aluminum and is of rectangular box section, tube 50 having a long rear wall 52 and a front short wall 54 and interconnecting side walls 55, 56.

The rear wall has a series of vertically spaced screw holes 58, 58 through which attaching screws 59, 59 are threaded into the wharf wood 60.

The outer wall 54 has a series of vent holes 62, 62 which are aligned with several of the holes 58 to admit the screws and tool therethrough.

The upper and lower edges 64, 66 are diagonally sheared as in the previous embodiment and the side walls are provided with longitudinal keyhole slots 67, 68, 69 & 70 which admit the cable or shank 72 of a ball, knot or enlargement therethrough; the ball being disposed within the bore 74 of the tube or the cable may be laced through several slots as required. In this embodiment the upper and lower slot may be of different widths and as shown the slot 67 may be wider than slot 68.

This embodiment may also be used as a cleat by applying it to a horizontal decking of a boat.

Thus, the device has several uses depending upon its positioning and fastening and in either position is well vented to pass air therethrough for cooling.

Several preferred embodiments of the invention have been disclosed, and it will be readily seen that in view of the foregoing disclosure various other embodiments will become apparent to those skilled in the art which fall within the purview of the appended claims:

I claim:

1. A mooring device comprising a tubular member having a bore and at least one open end, means for securing the device to an associated support, means providing a keyhole slot open at one end through said one end of said tube for admitting a mooring cable therethrough, said cable having an enlargement at its free end for preventing endwise movement of the cable out of the slot, and said tube having an edge at said one end extending diagonally of the axis of the bore away from the support and providing an enlarged open end for the bore to facilitate entry of said cable enlargement into the bore.

2. The invention according to claim 1 and said tube being formed of metal and having a quadrilateral cross-section and having front and rear walls and interconnecting side walls, said front wall having combination tool access holes and vents and said rear wall having screw-admitting holes aligned with respective tool access and vent holes, and said side walls having upper and lower slots extending from respective ends of said side walls for admitting a securing cable therein, said tube being open at both ends and positionable vertically on said support and adapted to draw air from the bottom of the tube and circulate the air through said bore and from said vent holes upwardly through the upper open end of the tube.

3. The invention according to claim 1 and said tube being vertically oriented and having openings at both ends and said bore serving as a chimney for passing heated air therethrough and thereby cooling said tube.

4. The invention according to claim 3 and said tube having an outer wall with a plurality of tool-access and vent holes therein.

5. The invention according to claim 1 and said tube being of resilient plastic material and adapted to flex to yieldably resist the tugging on the cable attached thereto.

6. The invention according to claim 5 and said slots having side edges spreadable apart to permit insertion and release of a cable of larger diameter than the normal spacing between said edges.

7. The invention according to claim 1 and said tube being of metal and having a rectangular cross-section and having side walls, and said slots being disposed in said side walls and extending from the ends of the tube to intermediate the ends thereof.

8. The invention according to claim 1 and said tube being of cylindrical cross-section and being open at both ends and having edges at both ends of the tube diagonally arranged to the axis of the tube and forming cable inlet openings of larger cross-sectional dimension than that of the bore to facilitate admittance of the cable enlargement thereinto.

* * * * *